US007294175B2

(12) United States Patent
Huang et al.

(10) Patent No.: US 7,294,175 B2
(45) Date of Patent: Nov. 13, 2007

(54) PERSONAL INHALATION FILTER

(76) Inventors: Jong T. Huang, 1245 Wilshire Blvd., #501, Los Angeles, CA (US) 90017; Vincent Jong-Tsong Huang, 1245 Wilshire Blvd., #501, Los Angeles, CA (US) 90017; Eugene J. Huang, 1245 Wilshire Blvd., #501, Los Angeles, CA (US) 90017

( * ) Notice: Subject to any disclaimer, the term of this patent is extended or adjusted under 35 U.S.C. 154(b) by 307 days.

(21) Appl. No.: 11/033,949

(22) Filed: Jan. 12, 2005

(65) Prior Publication Data

US 2005/0150385 A1 Jul. 14, 2005

Related U.S. Application Data

(60) Provisional application No. 60/536,034, filed on Jan. 13, 2004.

(51) Int. Cl.
*B03C 3/28* (2006.01)

(52) U.S. Cl. ..... 96/69; 55/486; 55/524; 55/528; 55/DIG. 35; 55/DIG. 39; 96/98; 96/390

(58) Field of Classification Search ..... 55/486, 55/527, 528, DIG. 33, DIG. 35, DIG. 39, 55/524; 96/55, 59, 66, 69, 98, 390
See application file for complete search history.

(56) References Cited

U.S. PATENT DOCUMENTS 5,240,479 A * 8/1993 Bachinski ..... 96/17
5,478,377 A * 12/1995 Scavnicky et al. ..... 96/17
5,496,507 A * 3/1996 Angadjivand et al. ..... 264/423
6,119,691 A * 9/2000 Angadjivand et al. ..... 128/206.19
6,261,342 B1 * 7/2001 Rousseau et al. ..... 95/59
6,364,935 B1 * 4/2002 Wennerstrom ..... 95/57
6,419,729 B1 * 7/2002 Duffy et al. ..... 96/17
6,428,610 B1 * 8/2002 Tsai et al. ..... 96/15
6,432,175 B1 * 8/2002 Jones et al. ..... 96/15
6,514,324 B1 * 2/2003 Chapman ..... 96/67
6,589,317 B2 * 7/2003 Zhang et al. ..... 96/62
6,638,621 B2 * 10/2003 Anderson ..... 428/402.24
6,790,259 B2 * 9/2004 Rittri et al. ..... 95/78
2001/0039879 A1 * 11/2001 Chapman ..... 96/69
2003/0089236 A1 * 5/2003 Zhang et al. ..... 96/59
2004/0016345 A1 * 1/2004 Springett et al. ..... 96/66

* cited by examiner

*Primary Examiner*—Richard L. Chiesa
(74) *Attorney, Agent, or Firm*—Chan Law Group LLP

(57) ABSTRACT

A cylindrical or other suitably shaped filter container for insertion into a user's nares to filter inhaled air to remove airborne items. The filter container has two open ends forming a container surrounding filter material. Polypropylene may be used to form the container or tube. Other suitable material such as rubber or other softer material may also be used. The present disclosure further includes a respiration mask having a peripheral seal composed of treated and fluffed polypropylene fibers. An edge seal according to the present disclosure lowers the respiratory resistance of a mask and improves the filtration efficiency. Treated, fluffed, polypropylene may also be used to form a respiration mask, such a mask may also include an edge seal to improve filtration and comfort. Treated, meltblown, polypropylene may also be used to form a filter napkin or handkerchief that may be carried and used in short term or unexpected situations.

4 Claims, 4 Drawing Sheets

PERSONAL INHALATION FILTER

RELATED APPLICATIONS

This application claims the priority of U.S. provisional patent application Ser. No. 60/536,034 filed Jan. 13, 2004.

BACKGROUND OF THE INVENTION

1. Field of the Invention

This disclosure relates to personal inhalation filters, and more specifically to filters adapted to fit the nares to prevent inhalation of airborne items.

2. Description of the Prior Art

Conventional masks adapted for use preventing the inhalation of infectious diseases do not create a complete seal around the periphery of the mask thus allowing unfiltered air to be inhaled by the wearer of the mask and potentially infectious particles to be exhaled around the periphery of a mask by the wearer. In addition, conventional masks that limit the size of particles to be transmitted, create noticeable and sometimes uncomfortable respiratory pressure for the wearer and restrict the complete exchange of exhaled gases forcing the mask wearer to reinhale their own breath. Conventional masks may also require removal for eating, drinking and often talking, they may also cause discomfort of the facial area covered by the mask.

What is needed is a more effective, more comfortable, and more convenient method and apparatus for preventing the inhalation of infectious diseases.

SUMMARY OF THE INVENTION

In a first aspect, the present disclosure may provide a cylindrical or other suitably shaped container having two open ends with the container surrounding filter material. In a currently preferred embodiment of the present invention, polypropylene may be used to form the container or tube. Other suitable material, such as rubber or other softer material, may also be used.

In another aspect, the present disclosure may include mesh or other suitable membrane connected to or otherwise covering one or more ends of a filter container or tube to further enclose the filter material.

In still another aspect, the present disclosure includes filter material and or a respiration mask composed of polypropylene material treated to impart a positive charge on the material to assist in attracting and capturing airborne bacteria and virus. A polypropylene mask may further include an edge seal of treated, fluffed polypropylene material to improve the efficiency of the mask.

In still another aspect, the present disclosure may include a connector between two nasal filters.

In another still further aspect, the present disclosure identifies that the restriction of air intake due to the presence of the nasal filters should be balanced against filtration needs to maximize user comfort while providing effective bacteria and virus filtering.

In another further aspect, the present disclosure may provide a filtered edge seal on a respiration mask to improve its comfort and efficiency. The edge seal may include treated and fluffed polypropylene fibers to lower the respiratory resistance and improve the filter efficiency of the mask. The addition of the raised edge seal may also lower the air flow resistance thus improving the apparent comfort of the mask.

In still another further aspect, the present disclosure may include a polypropylene filter napkin or handkerchief that may be easily carried for short term or unexpected situations in which a user may need to filter the air they inhale or exhale. A polypropylene filter napkin may be produced of meltblown polypropylene. A polypropylene filter napkin according to the present disclosure may be treated to impart a positive electrical charge on the fibers and thus provide electrical attraction for airborne micro-organisms.

In another still further aspect of the present disclosure polypropylene fibers to be used for respiratory filtering may be treated, such as with hexadecytriehylammonium bromide or dimethyldioctadecylammonium bromide to impart a positive electrical charge on the fibers and thus provide electrical attraction for airborne micro-organisms.

A nasal filter for attracting and capturing bacteria and virus according to the present disclosure may include a first portion of filter fibers having a positive electrical charge, and a second portion of filter fibers having a positive electrical charge and a first filter body containing the first portion of positively charged filter fibers, and a second filter body containing the second portion of positively charged filter fibers, the first and second filter bodies being sized to engage the nares of a user.

A personal inhalation filter for attracting and capturing bacteria and virus according to the present disclosure may include a generally planar layer of first filter fibers, and a generally planar layer of second filter fibers having a positive electrical charge, the first filter fibers and the second filter fibers overlapping to form a multilayer filter with the first filter layer forming an exterior side and the second filter layer forming a contact side, and a suitable means for securing the multilayer filter to the face of a user.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE PREFERRED EMBODIMENT(S)

Figure 1:
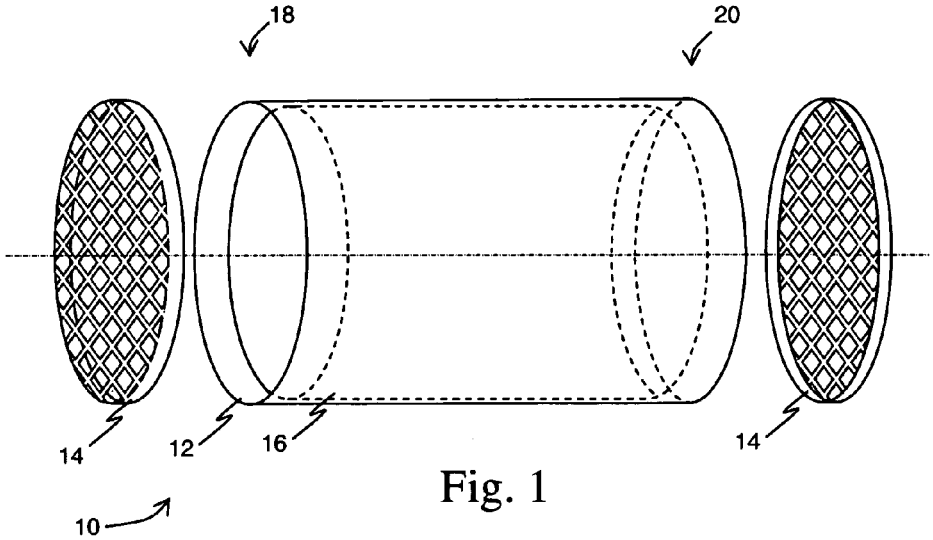
FIG. 1 is an exploded perspective view of a nasal filter according to the present disclosure.

Referring now to FIG. 1, nasal filter 10 includes filter container or tube 12 surrounding filter element 16. Tube 12 may be any suitable material such as but not limited to polyethylene, polypropylene or rubber. In a currently preferred embodiment of the present invention, tube 12 is a right circular cylinder. Nasal filter 10 may also include one or more membranes or screens such as end screen 14. End screens 14 may be secured or otherwise attached to first end 18 and or second end 20 to prevent the expulsion of filter media 16 from tube 12, and to serve as a first level gross filter for large airborne items.

Filter element 16 may be cotton or paper or other suitable filter media. Filter element may be produced to meet the N, R, and P respirator standards established by the National Institute for Occupational Safety and Health and the Centers for Disease Control and Prevention. In an alternate embodiment of the present invention, filter element 16 may be composed of polypropylene fibers in a loose and evenly distributed content having a preinsertion diameter of 2 centimeters, inserted into a 1 centimeter diameter tube 12. Polypropylene may be used as a filter material to employ the materials inherent weak electrical charge and the material's ability to have its electrical charge strengthened to capture airborne bacterial or virus. Polypropylene's hydrophobic properties may also be suitable for expelling airborne droplet material. The polypropylene fibers may be any suitable diameter, and testing has shown that fibers in the range 15-30 micrometers provide suitable filtration.

The filter media, whether polypropylene or other suitable polymer material, may be treated with hexadecytriehylammonium bromide or dimethyldioctadecylammonium bromide to impart a positive electrical charge on the fibers and thus provide electrical attraction for airborne micro-organisms.

End screens 14 may be produced of polypropylene or any other suitable material. End screens may be manufactured as part of tube 12 or as separate elements that require attachment to tube 12. End screens 14 may be a porous membrane or mesh using any suitable porosity or mesh geometry. In a currently preferred embodiment of the present disclosure membrane pore size ranges from 100-200 mm in diameter.

Figure 2:
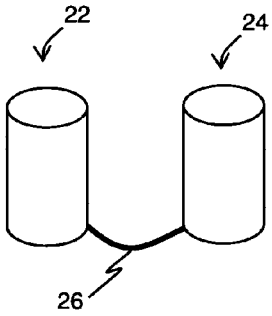
FIG. 2 is a perspective view of a pair of nasal filters joined according to the present disclosure.
Figure 6:
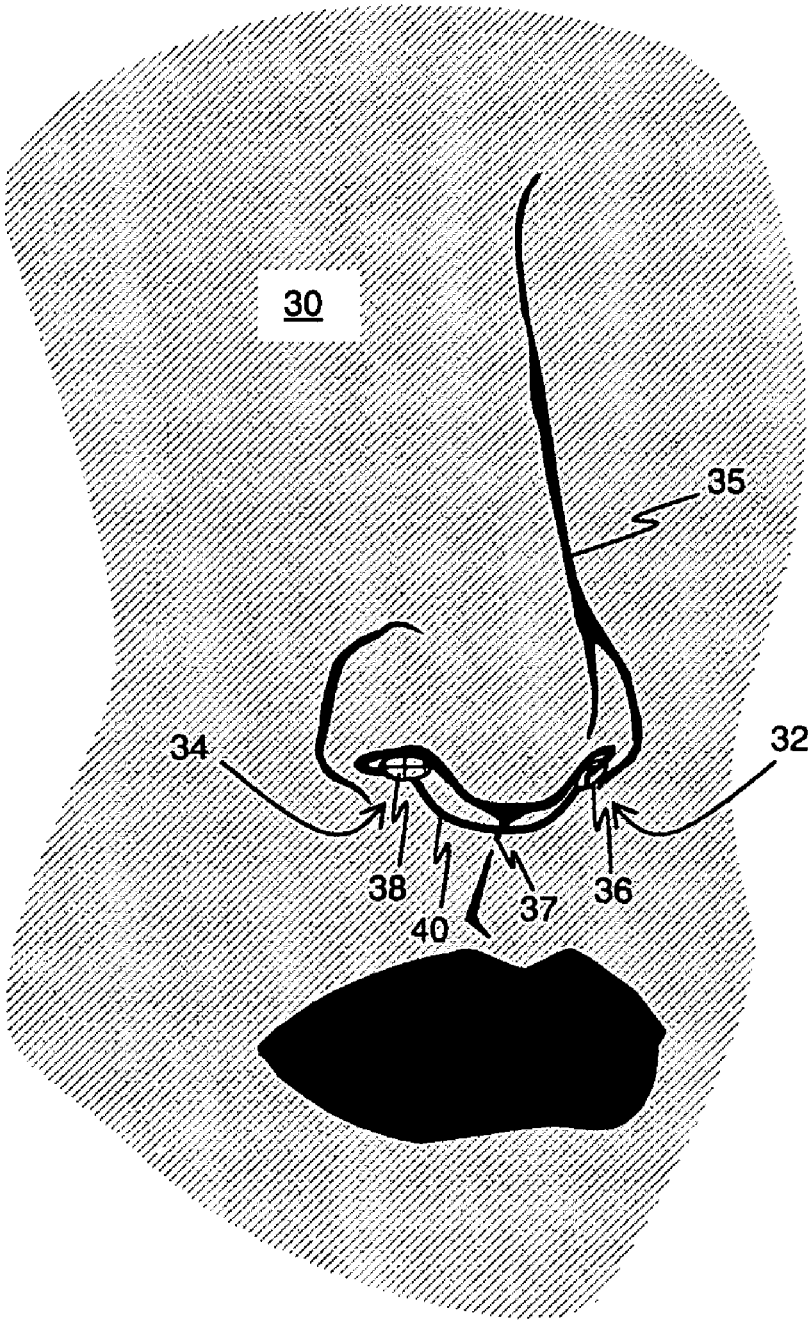
FIG. 6 is an enlarged drawing of a user implementing a connected pair of nasal filters according to the present disclosure.

Referring now to FIG. 2, in an alternate embodiment of the present disclosure, nasal filters 22 and 24 may be joined or otherwise attached together using connector 26. Connector 26 may provide a convenient grip to remove nasal filters 22 and 24 from user's nares without contacting nasal filters 22 and or 24 with the user's fingers. Referring now to FIG. 6, a nasal filter connector such as connector 40 may prevent over insertion of nasal filter 36 and or nasal filter 38 by engaging septum 37.

Figure 3:
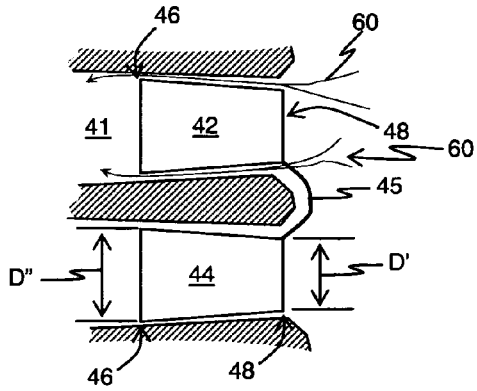
FIG. 3 is a side view of a connected pair of nasal filters, in a nose cross section, according to an alternate embodiment of the present disclosure.

Referring now to FIG. 3, in another embodiment of the present invention nasal filters 42 and 44 may be joined by filter connector 45. Nasal filters such as nasal filters 42 and or 44 may have a first end 48 and a second end 46 with the first end 48 having a smaller diameter D' than second end 46 diameter D". The diameters D' and D" may be selected to minimize passage of unfiltered air 62 through nasal passages such as nasal passage 41. Diameter D" may also prevent the unplanned expulsion of a nasal filter such as filter 42 from nasal passage 41.

Figure 4:
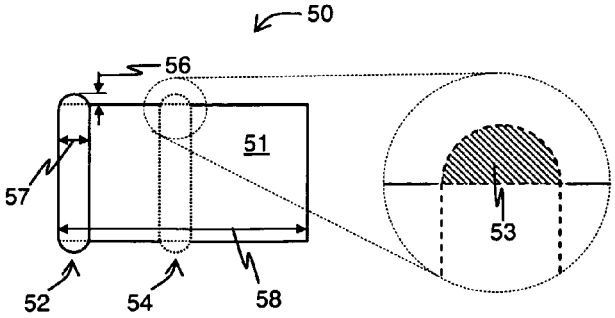
FIG. 4 is a side view of a nasal filter including a nasal seal according to an alternate embodiment of the present disclosure.
Figure 5:
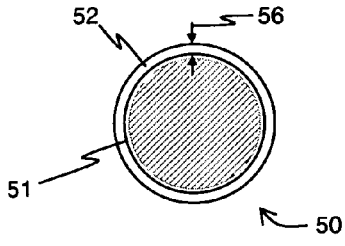
FIG. 5 is an end view of the nasal filter of FIG. 4.

Referring now to FIG. 4 and FIG. 5, in another alternate embodiment of the present invention nasal filter 50 may include one or more filter seals such as nasal filter seals 52 and 54 to engage a user's nasal passage such as nasal passage 41 and prevent unplanned expulsion or inhalation and or prevent unfiltered air such as air 60 from passing nasal filter 50. Filter seals such as seal 52 or nasal filter seal 54 may be located at any suitable location along length of nasal filter 50. Nasal filter seals such as seals 52 and 54 may be composed of the same material as filter tube 51. In another alternate embodiment of the present disclosure, filter seals such as filter seals 52 and 54 are composed of material softer than the material of tube 51 to better engage a nasal passage such as nasal passage 41.

Nasal seals such as nasal seals 52 and 54 may have any suitable elevation 56 above nasal filter 51. Nasal seal 54 is shown to have a hemispherical profile 53, although any other profile such as rectangular, ovoid, or any other suitable profile may be used. Similarly, width 57 of nasal filter seals such as seals 52 and 54 may be selected to optimize engagement with nasal passage 41, or may be selected to balance comfort against effectivness.

In another embodiment of the present invention, the material used to form tube 12 should be soft enough at human body temperature to adapt to the shape of the nare in which it is inserted to minimize leakage past tube 12. Tube 12 may be composed of soft closed cell foam that may be compressed prior to insertion and expand within the nasal passage of a user to form a tight seal.

Referring now to FIG. 6, safe use of nasal filters according to the present disclosure may require individual 30 to wash their hands before inserting a filter such as filter 38 or filter 36 into nares 34 and 32 respectively. Filters 38 and 36 should not be pushed too deeply into a user's nasal cavity; filter 38 should be inserted into nare 34, and filter 36 into nare 32, to a depth directly proportional to the individual's comfort, without filters 36 and 38 being too tight or loose. It is also necessary to breathe through nose 35, as breathing through the mouth will nullify the protection offered by filters 36 and 38. Nasal filter such as filters 36 and 38 may preferably be removed using connector 40 or by forceful exhalation, rather than using the fingers in contact with the used filters. In a currently preferred embodiment of the present invention, nasal filters such as filters 36 and 38 are recommended to be removed and replaced approximately every two hours.

Figure 7A:
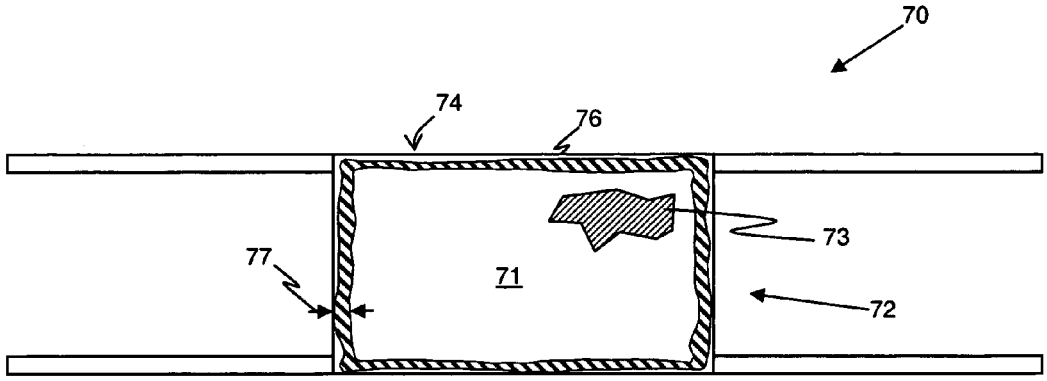
FIG. 7A is a top view of a respiration mask according to the present disclosure.
Figure 7B:
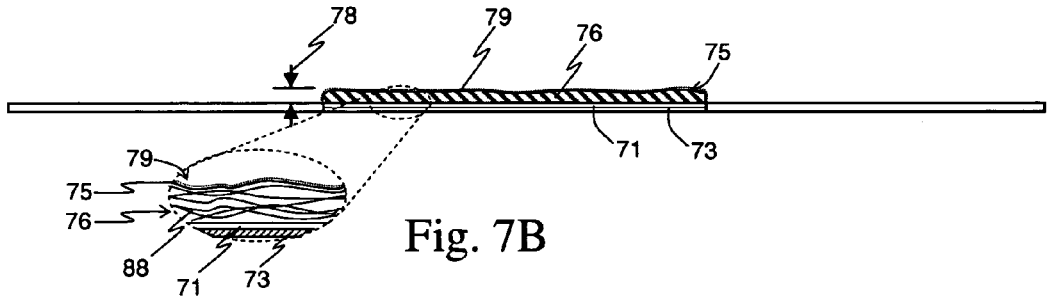
FIG. 7B is a side view of the respiration mask of FIG. 7A.

Referring now to FIG. 7A and FIG. 7B, respiration mask 70 includes primary filter 72 including edge filter 76 along periphery 74 of primary filter 72. Edge filter 76 has a width 77 and a thickness 78. Thickness 77 and width 78 may be controlled to improve the sealing efficiency, and the filtration efficiency of respiration mask 70. Respiration mask 70 may be secured to the face of a user using any suitable technique. In a currently preferred embodiment of the present disclosure edge filter 76 is fluffed polypropylene fibers 88 which have been treated to impart a positive charge to the fibers 88. Fibers 88 may be of any suitable size, in a preferred embodiment of the present disclosure fibers 88 have a diameter of about 25 μm.

Primary filter 72 may be formed of two or more layers such as gross filter layer 73 and poly filter layer 71. Gross filter layer 73 may use any suitable material such as cotton, gauze or paper and may be used as the exterior side of a mask such as respiration mask 70. Poly filter layer may be a polymer filter material such as polypropylene fibers that may be treated according to this disclosure and may form an interior layer or contact layer for mask 70. Contact layer such as poly filter layer 71 is in contact with a users face and forms the substrate for attachment of an edge filter such as edge filter 76.

In another embodiment of the present disclosure, surface 75 of edge filter 76 may be any suitable material such as porous fabric or gauze. Surface 75 of edge seal 76 may include any suitable adhesive material such as adhesive 79 to improve the sealing efficiency of mask 70.

Figure 8:
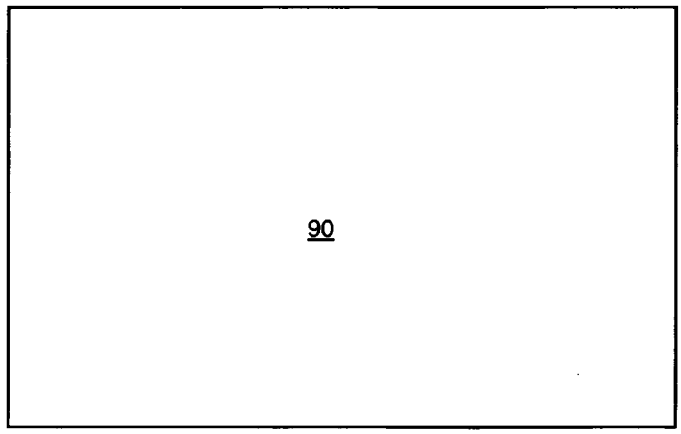
FIG. 8 is a top view of a respiration napkin according to the present disclosure.

Referring now to FIG. 8, in an alternate embodiment of the present disclosure, meltblown polypropylene may be used to form handkerchief or filter napkin 90 that may be easily carried for short term or unexpected situations in which a user may need to filter the air they inhale or exhale. Filter napkin may be treated using any suitable technique to impart a positive charge to filter napkin 90. In a currently preferred embodiment of the present disclosure filter napkin 90 is treated with hexadecytriehylammonium bromide or dimethyldioctadecylammonium bromide to impart a positive electrical charge on the fibers and thus provide electrical attraction for airborne micro-organisms.

Figure 9:
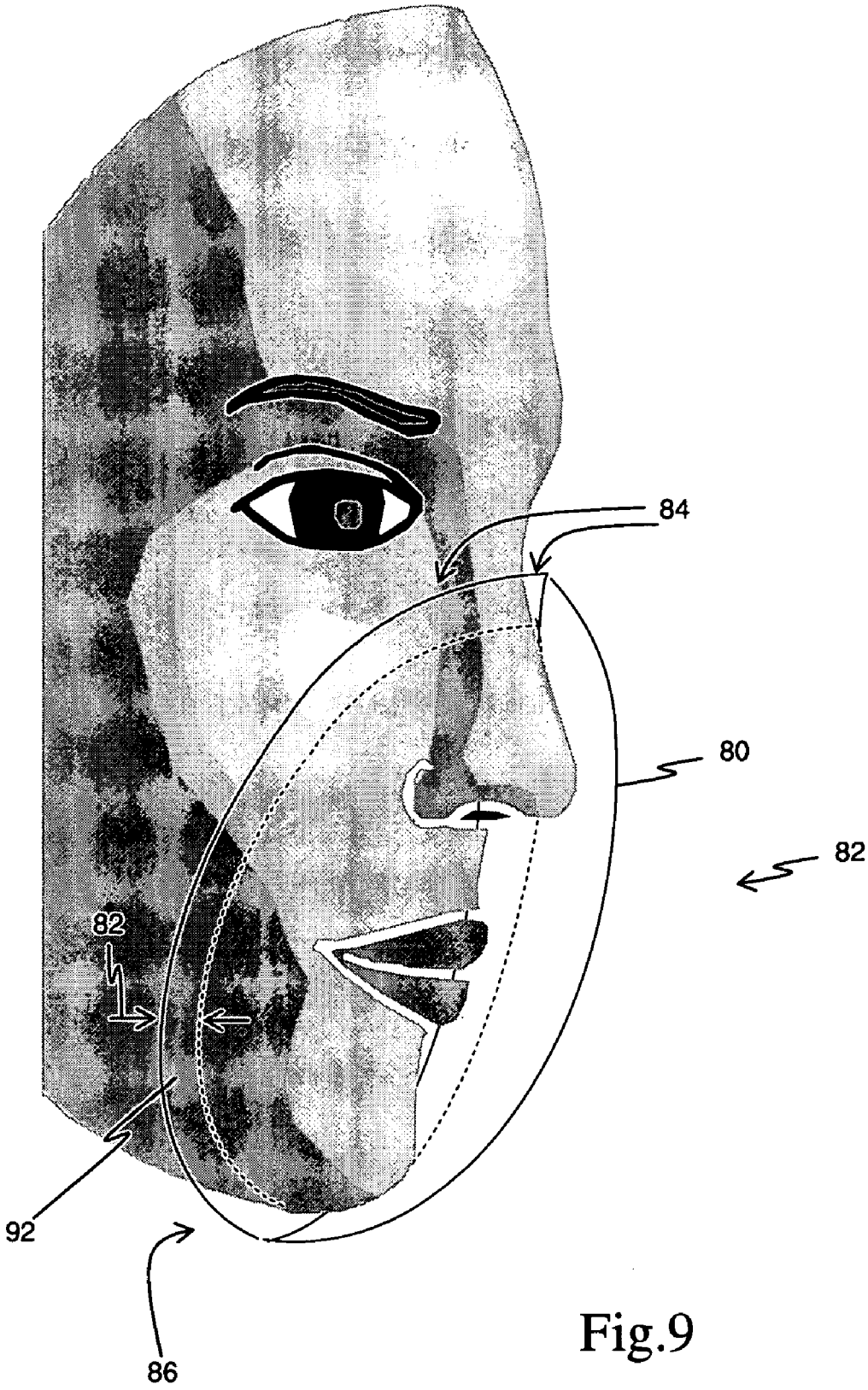
FIG. 9 is a perspective view of a respiration mask according to an alternate embodiment of the present disclosure.

Referring now to FIG. 9, in another embodiment of the present invention, mask 82 may be a facial cup type mask similar to N-95 filter masks. Filter 80 may include polypropylene treated to attract micro-organisms. Mask 82 may also include edge filter 92, which may be composed of loose polypropylene fibers 88.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

What is claimed is:

1. A personal inhalation filter for attracting and capturing bacteria and virus comprising:

a generally planar layer of first filter fibers;

a generally planar layer of second filter fibers having a positive electrical charge, the first filter fibers and the second filter fibers overlapping to form a multilayer filter with the first filter layer forming an exterior side and the second filter layer forming a contact side;

the second filter fibers further comprising polypropylene fibers, wherein the polypropylene fibers have a diameter of about 25 μm;

the polypropylene fibers treated with hexadecytriethylaminonium bromide or dimethyldioctadecylammoniuxn bromide;

an edge filter of fluffed polypropylene fibers having a contact side and an attachment side, the attachment side of the edge filter securing the edge filter along the perimeter of the contact side of the multilayer filter; and means for securing the multilayer filter to the face of a user.

2. A personal inhalation filter according to claim 1 further comprising:

an adhesive layer coating the contact side of the edge filter.

3. A personal inhalation filter for attracting and capturing bacteria and virus comprising:

a generally planar layer of filter fibers having a positive electrical charge, and an exterior side and a contact side;

the filter fibers further comprising polypropylene fibers, wherein the polypropylene fibers have a diameter of about 25 μm;

the polypropylene fibers treated with hexadecytriethylammonium bromide or dimethyldioctadecylammonium bromide;

an edge filter of fluffed polypropylene fibers having a contact side and an attachment side, the attachment side of the edge filter securing the edge filter along the perimeter of the contact side of the filter fibers; and means for securing the filter fibers to the face of a user.

4. A personal inhalation filter for attracting and capturing bacteria and virus comprising:

a generally planar layer of filter fibers having a positive electrical charge, and an exterior side and a contact side;

the filter fibers further comprising polypropylene fibers, wherein the polypropylene fibers have a diameter of about 25 μm;

the polypropylene fibers treated with hexadecytriethylammonium bromide or dimethyldioctadecylamnonium bromide;

an edge filter of fluffed polypropylene fibers having a contact side and an attachment side, the attachment side of the edge filter securing the edge filter along the perimeter of the contact side of the filter fibers;

an adhesive layer coating the contact side of the edge filter; and means for securing the filter fibers to the face of a user.

* * * * *